United States Patent [19]

Doll

[11] 4,331,243

[45] May 25, 1982

[54] GRAVITY FLOW RACK

[75] Inventor: Eugene N. Doll, Mundelein, Ill.

[73] Assignee: Market Innovators, Inc., Lombard, Ill.

[21] Appl. No.: 99,840

[22] Filed: Dec. 3, 1979

[51] Int. Cl.[3] ..... A47F 5/01

[52] U.S. Cl. ..... 211/49 D; 211/181; 211/184

[58] Field of Search ..... 211/49 D, 134, 153, 211/184, 181, 187, 207, 208

[56] References Cited

U.S. PATENT DOCUMENTS

| | | | |
|---|---|---|---|
| 2,803,352 | 8/1957 | Smola et al. | 211/187 X |
| 3,194,528 | 7/1965 | Chesley | 211/184 X |
| 3,929,248 | 12/1975 | Morrison | 211/184 X |
| 4,183,438 | 1/1980 | Huczek | 211/184 X |
| 4,231,301 | 11/1980 | Barrineau | 211/187 X |

FOREIGN PATENT DOCUMENTS

| | | | |
|---|---|---|---|
| 536572 | 12/1978 | United Kingdom | 211/184 |

*Primary Examiner*—Roy D. Frazier
*Assistant Examiner*—Robert W. Gibson, Jr.
*Attorney, Agent, or Firm*—David D. Kaufman

[57] ABSTRACT

A gravity flow rack particularly adapted for stocking and vending liquids such as milk and frut juices. The shelves comprise a bent wire frame and triangular bent wire divider-track members are adjustably mounted thereon to form parallel rows. The merchandise containers in each row are supported by only two thin, low friction wires so that accumulations of leaked liquids are reduced to a minimum and the racks are easily cleanable. The shelves are readily adjustable, both in angle of slope and spacing of merchandise rows.

9 Claims, 9 Drawing Figures

GRAVITY FLOW RACK

This invention relates generally to material storage and dispensing structures commonly known as gravity flow racks and, more particularly, to a rack adapted for use with products which frequently give rise to leakage and sanitation problems, such as, milk, fruit juices, and the like.

Heretofore, gravity flow racks have become well known and widely used in a variety of applications. In general, they comprised a bay or assembly of vertically spaced shelves or racks. The shelves were angled downwardly and forwardly and were provided with some form of low friction roller or track surface. Thus, when a shelf was stocked with a rearwardly extending row of an article (e.g., 6-packs of beer, individual bottles of soda, or the like), the purchaser could simply remove the front article and the remainder of the row would automatically slide forward to a ready position for the next purchaser. For heavy articles and material handling applications, the surfaces usually comprised parallel rows of relatively heavy duty rollers. For lighter applications of the type found in self service food or liquor stores, the shelves comprised parallel tracks of a low friction material such as nylon, teflon or neoprene. In either case, there was substantial surface contact between the racks and the bottoms of the articles being stocked or vended.

The peculiar problems attendant the commercial handling of certain fresh liquids such as milk, milk products and fruit juices are well known. Such products are packaged primarily in square paper-product containers which are coated with suitable plastics or paraffin. Those containers frequently tear or rupture so that the liquid contents are caused to leak out. The more durable rectangular, plastic gallon containers are likewise subject to leakage through their capped tops. When liquids such as milk and fruit juices collect on the supporting shelves or racks, unsightly, insanitary and bacteria-breeding conditions are created. Accumulations of such liquids also leave sticky residues which adversely affect the low friction sliding surfaces.

It is therefore an object of the present invention to provide a gravity flow rack adapted for milk, fruit juices and the like which eliminates or reduces substantially the problems described above. A related object is to provide such a gravity flow rack in which there is minimal surface contact with the bottoms and other surfaces of the containers.

In accordance with this invention, each of the shelves comprises a sturdy but substantially open bent wire frame. Triangular bent wire divider-track members are adjustably mounted on the frame to form the parallel merchandise channels or rows. The spaced triangular members form parallel rows having only a thin wire track adjacent each outer side thereof. Containers stocked in the rows thus are supported beneath by only two, thin wire tracks. The triangular divider-track members are coated with an epoxy enamel to give them low friction characteristics.

Another object of the invention is to provide a gravity flow rack of the character described which has a minimum number of universal parts and yet may be easily assembled and is adjustable to accommodate various sized containers.

A further object is to provide a gravity flow rack of the character described in which the shelves are readily removable and easily cleanable for sanitation purposes.

Yet another object is to provide a gravity flow rack of the character described in which the angle of slope of the individual shelves may be readily adjusted as desired.

Other objects, features and advantages of the invention will be apparent from the following detailed disclosure, taken in conjunction with the accompanying drawings, wherein like reference numerals refer to like parts, in which.

Figure 1:
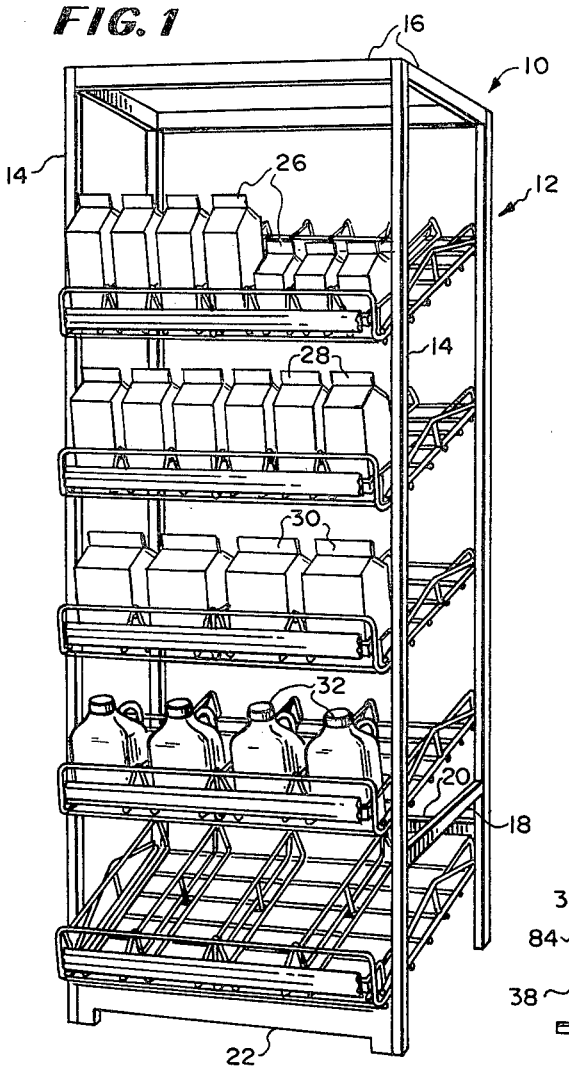
FIG. 1 is a perspective view of a gravity flow rack embodying the principles of the invention and showing the same partially stocked with milk containers of varying common sizes.

Turning in detail to the various figures of the drawings, the reference character 10 indicates generally a fully assembled gravity flow rack embodying the principles of the invention. Flow rack 10 comprises a rectangular supporting framework 12 having channel-shaped uprights such as 14 and rigidifying cross braces such as 16, 18, 20 and 22. A plurality of shelves 25 is adjustably and releasably mounted on the framework 12 and, as illustrated in FIG. 1, said shelves may be stocked with milk containers of varying conventional sizes such as quart and pint cartons 26, half-gallon cartons 28, gallon cartons 30 and gallon bottles 32.

Figure 2:
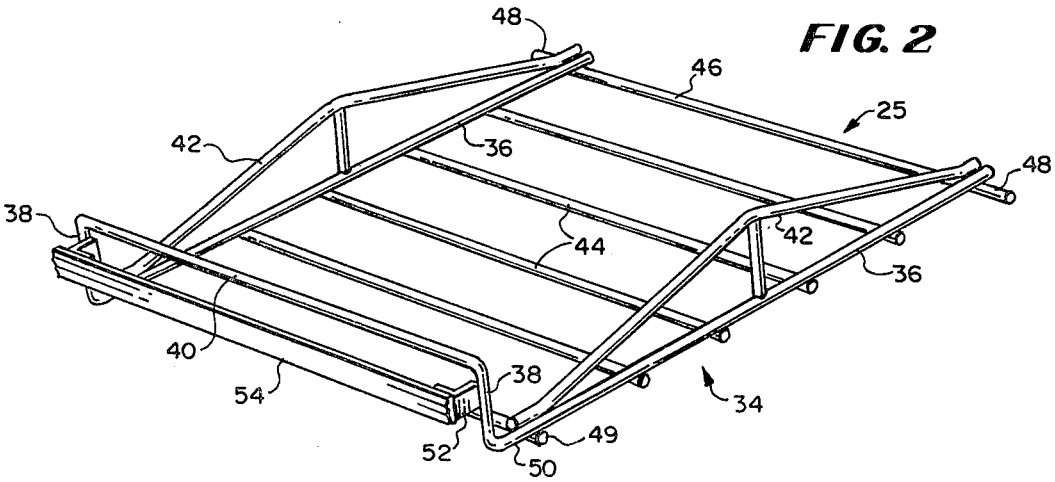
FIG. 2 is a perspective view of one of the shelves with the channel divider-track members removed.
Figure 3:
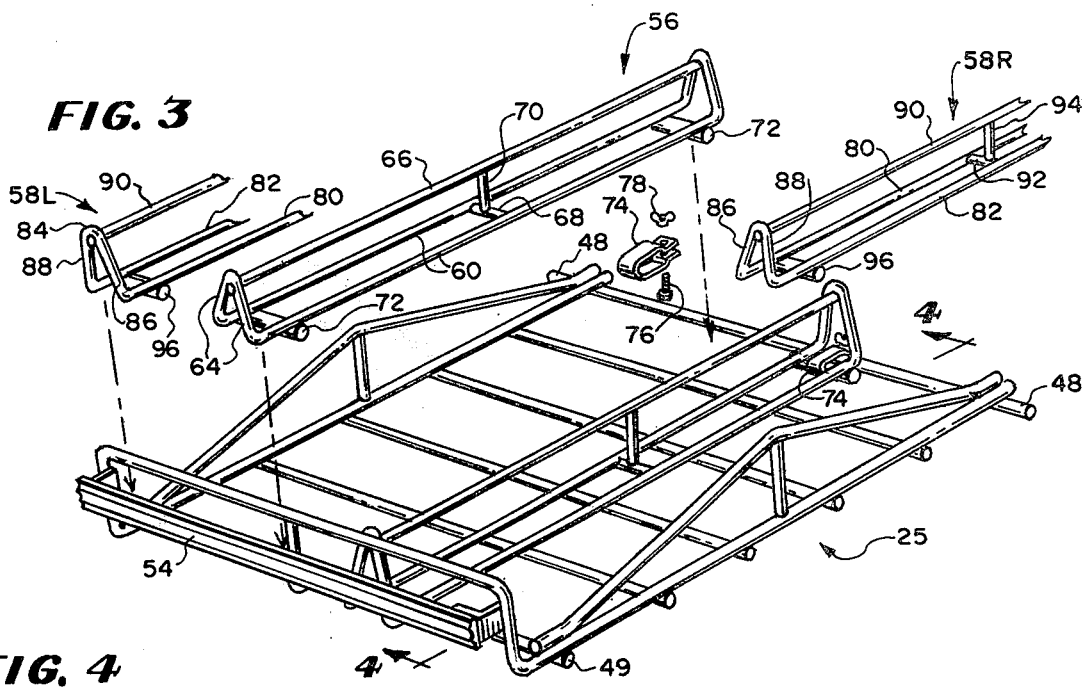
FIG. 3 is an exploded perspective view of a shelf showing the relationship of the divider-track members.
Figure 4:
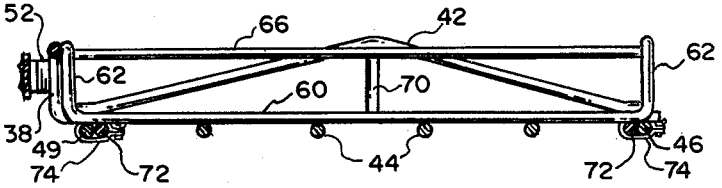
FIG. 4 is a sectional view taken on the plane of line 4—4 in FIG. 3 and viewed in the direction indicated.
Figure 6:
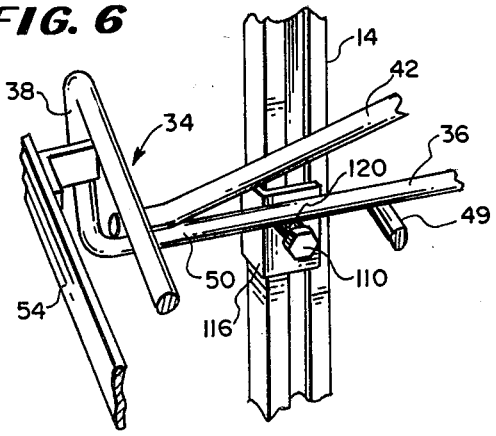
FIG. 6 is a fragmentary perspective view of the front support of the shelf.
Figure 7:
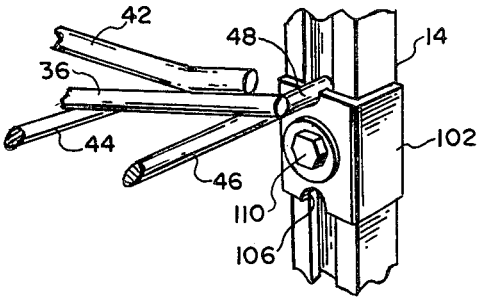
FIG. 7 is a similar view of the rear support of the shelf.
Figure 8:
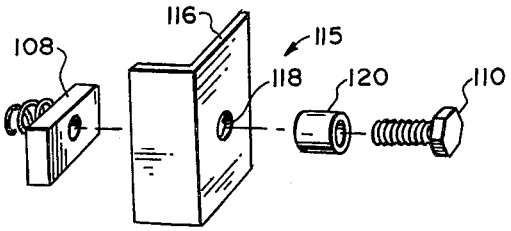
FIG. 8 is an exploded perspective of the front shelf support elements.
Figure 9:
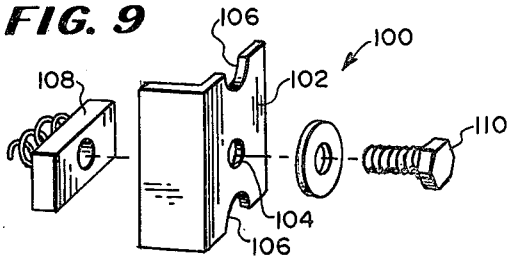
FIG. 9 is a similar view of the rear shelf support elements.

As shown in FIGS. 2, 3 and 4, each of the shelves 25 comprises a bent wire frame member 34 having parallel arms 36, 36 interconnected by front upright legs 38, 38 and a horizontal front retainer rod 40. Lateral supports 42, 42 are vertically connected, as by welding, to the arms 36, 36. A plurality of cross rods 44 is connected between the arms 36, 36 for structural strength. It will be noted that the rear cross rod 46 has portions 48, 48 which extend laterally beyond the arms 36 for reasons which will become apparent as the description proceeds. It will be similarly noted that the front cross rod 49 is positioned rearwardly of the front upright legs 38 to provide free, forwardly extending arm portions 50, 50.

The front upright legs 38 carry brackets 52, 52 and a front panel 54 for retaining advertising and price indicia in well known manner.

Figure 5:
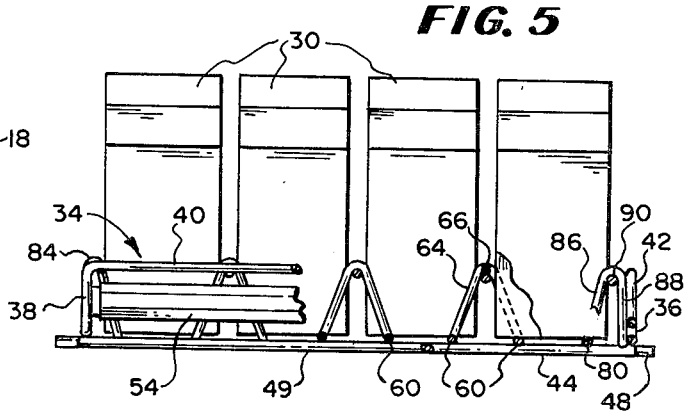
FIG. 5 is a front elevational view of a merchandise-stocked shelf with portions broken away to show the cooperation and interrelationship of parts.

Combination channel divider-track members are adjustably associated with the shelf 25 to provide tracks and storage channels or rows for the merchandise containers (see FIGS. 3 and 5). There are two types of divider-track members, namely, a twin-track or interior member indicated generally by the numeral 56, and a single-track or exterior member indicated generally by the characters 58L (left) and 58R (right). Interior member 56 comprises a bent wire pair of parallel tracks 60, 60 interconnected at their opposite ends by angular upright front and rear retainers 62, 62. The retainers 62 in turn comprise the equal legs 64, 64 of a baseless isosceles triangle.

A divider rod 66 is connected between the retainers 62, 62 at the apex of the angle between the legs 64, 64. Horizontal and vertical structural members 68 and 70 are provided as indicated for rigidifying the divider-track member structure. Mounting rods 72, 72 are connected to the underside of the tracks 60, 60, and it will be noted that they are spaced to fit in abutting relationship with the front cross rod 49 and rear cross rod 46 (see FIG. 4). Clips such as 74 and cooperating bolts 76 and wing nuts 78 releasably grip an associated mounting rod 72 and cross member 46 or 49 to retain the track members on the shelf 25 in any desired adjusted position. The entire twin-track divider 56 is coated with an epoxy enamel which greatly reduces the coefficient of friction of all external surfaces.

Referring to FIG. 5 of the drawings, it will be seen that the structure of the single-track dividers 58L and 58R is substantially the same with the exception that the number of tracks and retainers and the apex angle is reduced by one-half. Since members 58L and 58R are identical, but mirror images of each other, it is necessary to describe in detail only one. Thus, divider 58R comprises a bent wire track 80 and parallel lateral rod 82, interconnected at their opposite ends by angular upright front and rear retainers 84, 84. Each of the retainers 84 comprises a a hypotenuse 86 and an altitude 88 of a baseless right triangle. Similarly, the apex angle between the hypotenuse 86 and altitude 88 is approximately one-half of that between the retainer legs 64, 64 of the twin-track dividers 56. Divider rod 90 is connected between the retainers 84, 84 at the apex angle. Structural members 92 and 94 and mounting rods 96, 96 complete the single-track structure which is likewise releasably and adjustably mounted by means of the clips 74. Once again, the dividers 58L and 58R are coated with a low friction epoxy enamel.

Cooperation and function of the shelf and divider members thus far described may now be seen with reference to FIG. 5. Twin-track and single-track members 56 and 58 are mounted on the shelf 25 in any desired spaced relationship to provide storage channels for the liquid containers. When so arranged, a stored container, such as the gallon cartons 30 illustrated, is supported beneath only by two, thin wire tracks 60, 60 or 60, 88. At the same time, the container storage channels themselves are defined by pairs of adjacent divider rods 66, 66 or 66, 90. Since said divider rods are adjusted and spaced to provide nominal lateral clearance with the stocked containers, such containers normally have minimal contact with only the two thin wire tracks therebeneath.

Additionally, the front (and rear) container in any stocked rod contacts only a pair of angular retainer legs 64, 64 or 64, 86. Said angular retainer legs provide secure retaining support for even a fully stocked, and relatively heavy, row of containers, and also avoids shocks to the longer and weaker vertical surfaces of each front container which frequently cause breaks and ruptures. In this regard, I have determined that optimum efficiency and container safety is obtained when the apex angle between the legs 64, 64 is in a range between 35° and 50°, and preferrably around 40°. Similarly, the optimum angle between the legs 86 and 88 is in a range of 17.5° and 25°, and preferrably around 20°.

The shelves 25 are adjustably mounted on the framework 12 by means illustrated in FIGS. 6–9. The rear mounting means 100 comprises an L-shaped mounting plate 102 adapted to be positioned on the upright 14. Plate 102 is formed with a central hole 104 and a pair of notches 106, 106 adapted for alignment with the open channel of the upright 14 as illustrated. The plate 102 is adjustably connected to the upright 14 by means of a spring-loaded internally threaded nut 108 and cooperating bolt 110.

The front mounting means 115 comprises an L-shaped plate 116 having a central hole 118 adapted to be aligned with the channel of the upright 14. Again, the plate 116 is adjustably mounted on said upright with a spring-loaded nut 108 and bolt 110. A spacer ferrule 120 is mounted on the bolt 110 and serves to space the head of the bolt from the plate 116.

To mount the shelf 25 it is simply necessary to position the laterally extending portions 48 of the rear cross rod 46 in the notches 106 of a pair of plates 102. At the same time, the forward arm portions 50 of the shelf are simply freely positioned on the opposed spacer ferrules 120. It will thus be appreciated that the angle of shelf slope may be readily adjusted or the shelves readily removed as desired.

It will be understood that modifications and variations may be effected without departing from the scope of the novel concepts of the present invention, but it is understood that this application is to be limited only by the scope of the appended claims.

The invention is hereby claimed as follows:

1. A gravity flow rack comprising:

a vertically oriented framework;

a bent wire shelf comprising a bent wire rod member having a pair of parallel arms interconnected by front upright legs and a front horizontal segment, and front and rear cross rods connected to said parallel arms;

a pair of bent wire divider-track members on said shelf, each of said divider-track members comprising a single-wire track and cooperating to form a merchandise row wherein merchandise containers are supported beneath by only the two wire tracks;

connector means releasably connecting said divider-track members to said shelf; and mounting means releasably and adjustably mounting said shelf on said framework, each of said divider-track members comprising further a pair of mounting rods spaced for abutment with said front and rear cross rods for connection thereto by said connector means.

2. The gravity flow rack of claim 1 in which said connector means comprises hand-adjustable clamps and cooperating bolts and nuts.

3. The gravity flow rack of claim 1 in which each of said divider-track members comprises front and rear angular retainers integral with said wire track and defining the front and rear of the merchandise row.

4. The gravity flow rack of claim 3 in which the angle between said angular retainers and the vertical is in the range of 17.5° and 25° and the retainers of the divider-track members of the pair are opposed.

5. The gravity flow rack of claim 4 and comprising further a divider rod connected between said front and rear angular retainers, said divider rods defining the lateral sides of the merchandise row.

6. The gravity flow rack of claim 5 in which a pair of said front and rear angular retainers projects from said divider rod, each of said front and rear retainers being integrally connected by a single-wire track whereby adjacent pairs of divider-track members cooperate to form pairs of said merchandise rows.

7. The gravity flow rack of claim 6 in which the angle between said pair of angular retainers is in the range of 35° and 50°.

8. A gravity flow rack comprising:

a vertically oriented framework;

a bent wire shelf comprising a bent wire rod member having a pair of parallel arms interconnected by front upright legs and a front horizontal segment, and front and rear cross rods connected to said parallel arms;

a pair of bent wire divider-track members on said shelf, each of said divider-track members comprising a single-wire track and cooperating to form a merchandise row wherein merchandise containers are supported beneath by only the two wire tracks;

connector means releasably connecting said divider-track members to said shelf; and mounting means releasably and adjustably mounting said shelf on said framework, said rear cross rod having end portions extending laterally beyond said parallel arms, and said mounting means comprising notched plates releasably attachable to said framework and adapted to support said end portions therein.

9. The gravity flow rack of claim 8 in which said front cross rod is positioned rearwardly of said upright legs to afford free forward portions of said parallel arms, and said mounting means comprises further bolts and spacer ferrules releasably attachable to said framework, said forward portions being freely supported by said ferrules.

* * * * *